United States Patent [19]

Fournier et al.

[11] Patent Number: 4,562,877

[45] Date of Patent: Jan. 7, 1986

[54] METHOD OF RAPIDLY SOLIDIFYING THIN METALLIC STRIPS

[75] Inventors: Pascal Fournier, Paris; Jean-Claude Peraud, Mandres Les Roses, both of France

[73] Assignee: Pont-a-Mousson S.A., Nancy, France

[21] Appl. No.: 684,834

[22] Filed: Dec. 21, 1984

Related U.S. Application Data

[62] Division of Ser. No. 284,346, Jul. 17, 1981, Pat. No. 4,520,859.

[30] Foreign Application Priority Data

Jul. 18, 1980 [FR] France ..... 80 15918

[51] Int. Cl.[4] ..... B22D 11/06; B22D 27/15

[52] U.S. Cl. ..... 164/463; 164/474; 164/475; 164/479

[58] Field of Search ..... 164/463, 474, 475, 479

[56] References Cited

U.S. PATENT DOCUMENTS 4,142,571 3/1979 Narasimhan ..... 164/429 X 4,271,894 6/1981 Kimura et al. ..... 164/481

4,339,508 7/1982 Tsuya et al. ..... 164/429 X

*Primary Examiner*—Nicholas P. Godici

*Assistant Examiner*—J. Reed Batten, Jr.

*Attorney, Agent, or Firm*—Pennie & Edmonds

[57] ABSTRACT

A method of rapidly solidifying thin metallic strips, comprising projecting a jet of molten metal or alloy under reduced atmospheric pressure onto a cold substrate moving at high speed, thereby forming the strip in contact with the substrate, and then bringing the strip rapidly into higher atmospheric pressure. Forming the strip on the substrate under reduced atmospheric pressure improves the quality of the edges and surface of the strip, while bringing the strip rapidly into higher atmospheric pressure improves the adherence of the strip to the substrate. If the strip is brought into higher atmospheric pressure before its temperature falls to the temperature of vitrification, the properties of the vitreous metal formed, including its ductility, are also improved, because of the more rapid passage through the temperature range above the vitrification temperature than if the metal were cooled under reduced pressure.

26 Claims, 10 Drawing Figures

METHOD OF RAPIDLY SOLIDIFYING THIN METALLIC STRIPS

CROSS-REFERENCE TO RELATED TO RELATED APPLICATION

This is a division of U.S. patent application Ser. No. 284,346, filed July 17, 1981, now U.S. Pat. No. 4,520,859, issued June 4, 1985.

BACKGROUND OF THE INVENTION

1. Technical Field

This invention relates to the manufacture of thin strips of metal by casting and quick setting molten metal on a cold substrate which is moving at high speed, and in particular to the production of metal materials in the vitreous state by means of a rapid solidification process.

2. Description of Related Art

It is possible to impart a vitreous or amorphous structure, i.e., one which fails to exhibit any crystalline structure on X-ray exposure (see "Les verres métalliques" (Metal glasses), Praveen Chaudhari, Bill Giessen and David Turnbull, in "Pour la Science," June 1980, No. 32, p. 68, and Scientific American, Vol. 242, No. 4, at 84–96, April 1980) by a process of cooling certain molten metals or alloys at very high speed, on the order of $10^6$ ° C./second.

Such processes of producing an amorphous metallic structure generally comprise projecting a jet of molten metal onto a cooled surface which is a good heat conductor and is moving at high speed, so that the metal spreads in the form of a very thin layer over the surface.

Various processes of solidifying molten metal on cold moving surfaces have been proposed in the prior art. These processes include solidifying the metal in the following ways: inside a wheel, on a drum, on a disk, and between two rollers. The simplest and most commonly used method consists of projecting a jet of molten metal onto the outside surface of a cold metal wheel turning at high speed. The molten metal, ejected under pressure from a crucible, forms a stationary bulb on contact with the wheel which produces a rapidly solidified metal strip. The strip, under the effect of centrifugal force, separates from the cold wheel and is ejected.

Studies made of these different types of processes have revealed the influence of the boundary gaseous layer in contact with the cold surface on the quality of the edges and on the condition of the surface of the metallic strip.

These studies have led to proposals for operating under a controlled atmosphere and, notably, under low pressure, by placing all of the equipment in a closed vessel. One major disadvantage of this technique, however, resides in the volume of the vessel that must be built, particularly when the process is used on an industrial scale. Moreover, when a vacuum is applied to the system, it cannot be applied continuously because the vacuum is necessarily broken every time the strip product is removed. In addition, it has been found that, in the process of rapid solidification on a wheel, a separation of the strip takes place more rapidly when operating under vacuum than when the process is conducted in the open, and solidification is less intense.

It is, of course, possible to contemplate rapidly solidifying the metal under vacuum and continuously bringing the strip out of the vessel. However, it is difficult to adapt a vacuum vessel to a very fast-turning wheel to permit the maintenance of a satisfactory continuous vacuum while allowing the strip to emerge into the atmosphere, especially in view of the fact that separation of the metal strip from the wheel is an unstable phenomenon.

This serious disadvantage, in particular, led to the search for a technique of rapid solidification under a controlled atmosphere which did not involve centrifugal force, and with that end in view, use of the method of rapid solidification on a moving band, passing at high speed under the jet of molten metal. This method, known in principle, presents appreciable disadvantages, principal among which is vibration of the supporting band. Generally, the problem of imprecise positioning of the band results from the fast-turning pulley drive of the apparatus, the difficulty of cooling the band effectively, and the greater complexity of this method than rapid solidification on a wheel.

SUMMARY OF THE INVENTION

The invention is aimed at overcoming the difficulties involved in the process of rapid solidification on a moving band, with a view to view to utilizing it under a controlled atmosphere, and possibly under reduced pressure. It makes it possible to position the moving band precisely and to tender its vibrations negligible, while assuring at least in part its cooling, by placing opposite at least one of the faces of the band a unit containing one or more openings (holes, slits, etc.) through which a fluid under pressure, preferably a gas at low temperature, is ejected in the direction of the band, in order to create a fluid cushion between the band and the unit. This cushion positions the band without generating any friction against the unit, while assuring the band's cooling, notably by formation of a fluid cushion employing the Coanda effect. The Coanda effect is described, for example, in an article in "Science et Vie," August 1974, pp. 68–73 (published by Excelsior Publications, 5, rue de la Baume, Paris 8e).

This invention therefore relates to an apparatus for rapidly solidifying a metal or an alloy as it is formed into a thin strip, the device containing a band moving transversely at high speed below an opening for ejection under pressure of the metal or alloy in the molten state. Opposite at least one of the faces of the band, and in proximity to the zone of impact of the molten metal or alloy on the band, there is at least one unit containing at least one opening for ejection of a fluid under pressure, preferably at low temperature, creating between the band and the unit a fluid cushion which holds the band to the unit without friction.

One unit is preferably placed "upstream" (with respect to the direction of movement of the band) of the impact zone of the molten metal, and it can advantageously be situated face-to-face with the impact surface in case it is desired to modify the nature of the gas of the boundary layer in the impact zone.

The openings for ejection of this fluid under pressure may consist of straight slits or small holes, aligned in one or more rows.

The moving band will usually consist of a continuous metal strip which is pulled by a drive member such as a drum or a pulley and passes over one or more return members. The return members will advantageously consist of stationary curved units cntaining at least one opening for ejection of a gas under pressure, preferaby at low temperature, creating under the band a gas cushion which exhibits the Coanda effect, which maintains the band at a fixed distance from said unit.

In one advantageous embodiment of the invention, the device will contain, "downstream" of the zone of impact of the molten metal, and face to face with the surface opposite the impact surface, a preferaby concave unit employing the Coanda effect, so placed that the moving band follows, after impact of the molten metal, a path having a curvature such that the impact face of the band remains concave, and thus tends, by the effect of inertia, to keep the strip in close contact with the band.

As indicated above, the rapid solidification device according to the invention lends itself particularly well to continuous rapid solidification under a controlled atmosphere and, in particular, under reduced pressure. In this connection, the rapid solidification device comprises a vessel in which is placed the opening for ejection under pressure of the molten metal or alloy, the opening being continuously traversed by the band. An inlet slit and an outlet gate are provided for passage of the band in the vessel, as well as at least one opening for control of the atmosphere which is capable of serving particularly as a vacuum connection for work under reduced pressure.

It is, of course, not generally desirable for the openings for ejecting the gas cushion employing the Coanda effect to feed into the interior of the vessel, and this possibility is practically excluded, even when the apparatus is used under reduced pressure. In that event, it is desirable for a cushion with the Coanda effect to be placed under the band downstream of the vessel and as close as possible to the outlet gate, in order to avoid friction of the upper face of the band with the outlet gate, and it is advantageous for a second cushion to be placed upstream of the vessel and as close as possible to the inlet slit.

This inlet slit, which is intended only to permit free passage of the supporting band, of well-defined cross-section and position, can be made in the form of various devices of the known art, such as intermediate joints, locks or chambers, which keep the intake of air inside the vessel at a low level.

The outlet gate is more difficult to make, for it must make possible, not only passage of the supporting band, but also that of the strip manufactured inside the vessel. In particular, when the vessel is placed under reduced pressure, due to the play that necessarily must be provided above the band for outlet of the strip, a gas flow is produced, emanating from outside the vessel, which tends to separate the strip from the band and prevent its outlet and, therefore, its recovery. However, tests have shown that this difficulty is overcome when the distance between the impact zone and the outlet is below a critical value. The latter is generally very low, of the order of a centimeter, and seems to correspond to the zone where the strip is still hot enough to adhere to the band.

To prevent the gas flow coming from outside the vessel through the outlet gate from disturbing the jet of molten metal, or the bulb formed on its impact on the band, or the spread and cooling of the strip, it is advisable for the vacuum connection or connection of the vessel to the placed in the immediate vicinity of the outlet gate. These vacuum connections are preferably arranged in identical pairs, symmetrically with respect to the supporting band and in proximity to its edges.

In practice, maintenance of the distance between the impact zone and outlet below a maximum critical value is rendered difficult by the size of certain members and, notably, by the size of the crucible containing the molten metal and its means of heating, which are placed in that region of the vessel.

To remedy that difficulty, it is possible to use an outlet gate structure shifted toward the inside of the vessel and preferably removable and interchangeable, so as to enable the device to be easily adapted to the working conditions chosen, such as the dimensions and speed of the band, the nature of the alloy, the temperature of use, and the width of the strip to be produced.

Tests further have shown that there is an advantageous embodiment capable of accommodating the size of the different members, some of which are at high temperature, situated inside the vessel in the outlet zone. In fact, the strip can be produced under reduced pressure and its emergence from the vessel effected quite well, even if the distance between the impact zone and the downstream wall of the vessel is quite great. This is accomplished by placing, above and at a very short distance from the strip supported by the band, a hood-shaped piece having a surface roughly parallel to the band and covering it between the outlet and a point whose distance from the impact zone is no greater than the critical distance previously defined.

The use of such hoods is particularly advantageous, for it makes it possible to place lateral vacuum connections, situated in the vicinity of the outlet and on both sides of the band, in very direct communication with the slit through which the strip comes out of the vessel.

The tests conducted under reduced pressure with such a divice have proved fully satisfactory, for one finds that the metal glass strip formed in contact with the band remains adhered to the latter over a distance sufficient to enable it to be extracted from the vacuum chamber and recovered continuously, e.g., by centrifugal ejection.

DETAILED DESCRIPTION OF PREFERRED EMBODIMENTS

Figure 1:
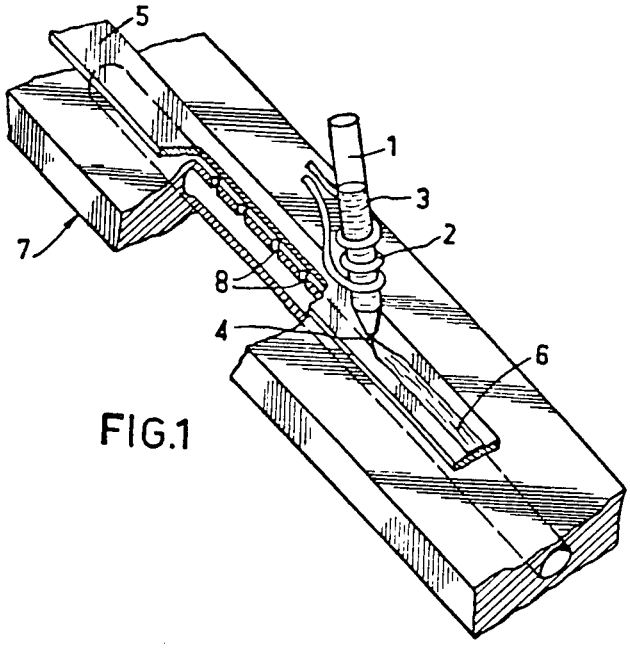
FIG. 1 is a schematic view illustrating a rapid solidification device according to an embodiment of the invention, equipped with a unit employing the Coanda effect, placed below the moving band.

Referring to FIG. 1, there is seen a crucible 1, surrounded exteriorly by a solenoid 2, making it possible to heat to a temperature exceeding melting temperature the metal 3 contained in crucible 1. The molten metal can be ejected under pressure through a nozzle 4 in the direction of a metal band 5, driven at high speed (by means not shown in FIG. 1) under nozzle 4. In contact with band 5, the molten metal undergoes rapid solidification and forms a metal strip 6 in the vitreous state, which adheres to and is carried away by band 5.

Figure 2:
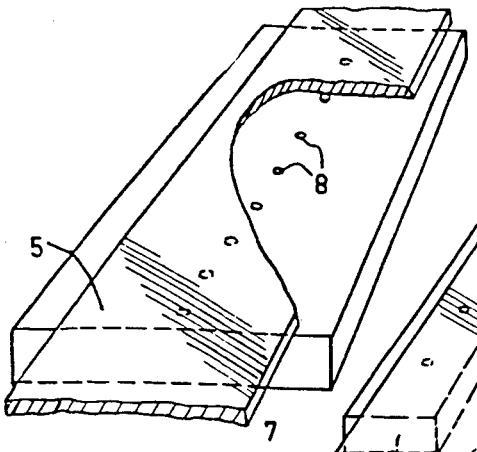
FIGS. 2, 3, 4, and 5 represent variants of such a unit.

According to further features of the invention, a unit 7, drilled with holes 8 along the middle line of band 5 (FIG. 2), is placed below the latter, and a gas under pressure (air, helium, nitrogen or other gas), preferably at low temperature, is projected through holes 8 in the direction of band 5, so as to form under the band a gas cushion, which applies the band against the unit 7 by the Coanda effect. The gas cushion guides the band in its high-speed movement under nozzle 4 and thus eliminates its vibrations, notably those originating from the drive device. It also contributes to the cooling of band 5, in order to remove the calories introduced by the molten metal.

Figure 3:
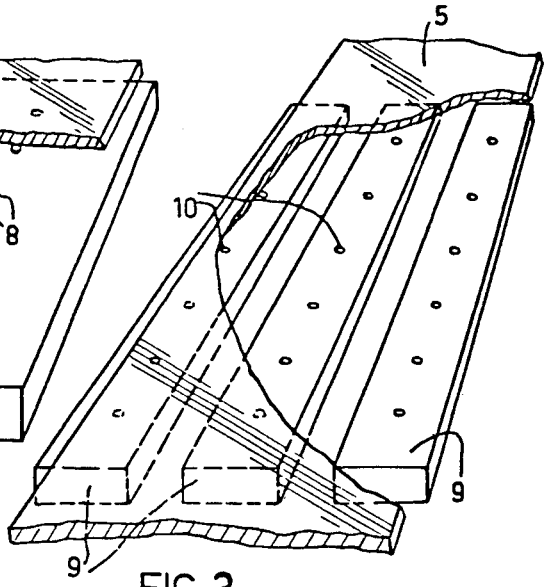
Figure 4:
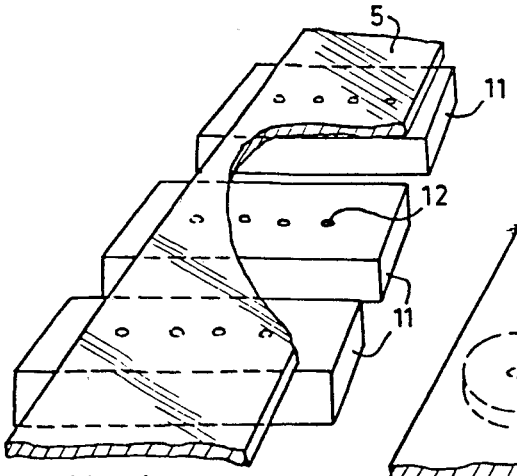
Figure 5:
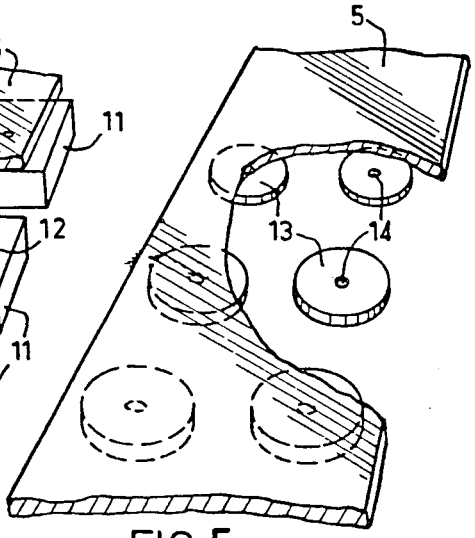

It is, of course, possible to use multiple units 9 drilled with holes 10 aligned parallel to the direction of feed of band 5 (FIG. 3). Alternatively, units 11, provided with openings 12, may be placed perpendicularly to band 5 (FIG. 4). Studs 13 may also be used, provided with openings 14 (FIG. 5), possibly in staggered arrangement. The openings may also be in the form of slits.

As indicated above, the device according to the invention is particularly suitable for rapid solidification under reduced pressure or under any controlled atmosphere.

Figure 6:
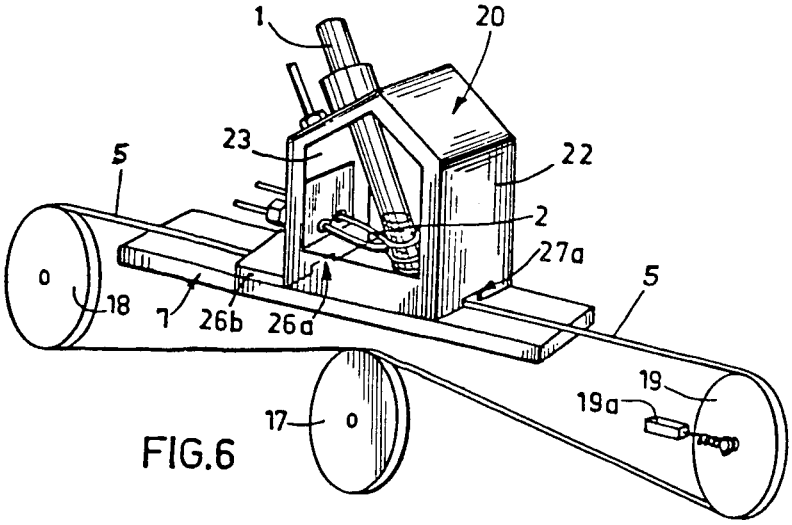
FIG. 6 is a schematic view of a device according to an embodiment of the invention for rapid solidification of a metal or alloy under controlled atmosphere.

FIG. 6 illustrates such an application. Moving band 5, pulled by a drive pulley 17, passes over two return pulleys, one stationary pulley 18 and the other pulley 19 being mounted on a tension block 19*a*. It traverses a vessel 20, the lower part of which consists of the plate of a cooled unit 7, the latter containing openings fed with fluid under pressure, to form the gas cushion employing the Coanda effect. These openings, placed under band 5 solely upstream and downstream of the site of vessel 20, are not visible in FIG. 6.

Referring further to the drawing, vessel 20 contains a frame 22, laterally equipped with transparent walls 23, making it possible to observe the operations. In vessel 20, as previously, a crucible 1 is provided, equipped with a solenoid 2, which makes it possible to melt the metal or alloy contained in the crucible.

Figure 10:
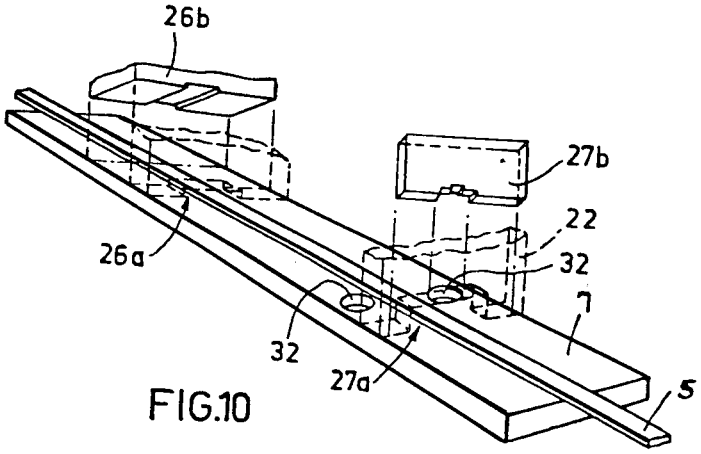
FIG. 10 is an exploded detailed view showing simple forms of inlet and outlet pieces for the vessel.

Vessel 20 contains, for the passage of band 5, an inlet opening 26*a* (FIG. 6), blocked by a removable piece 26*b* (FIG. 10). The lower face of piece 26*b*, which contains a groove of width and depth suited, with slight play, to the dimensions of band 5, is applied to supporting unit 7. An outlet opening 27*a* (FIG. 6), blocked by a gate 27*b* (FIG. 10), is also mounted on the unit so as to allow passage of the band and vitreous metal strip.

Improved variants of the outlet gate are described below.

Figure 7:
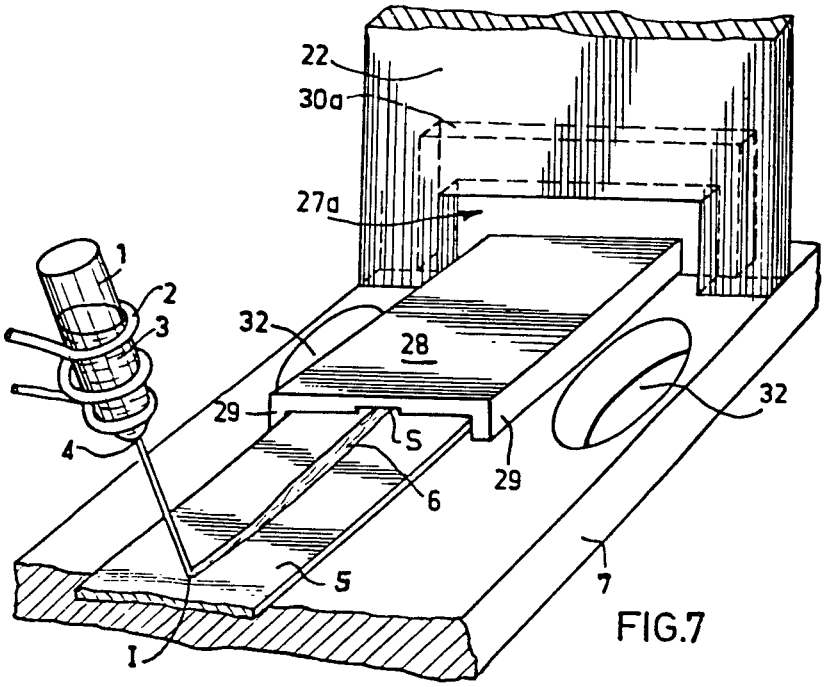
FIG. 7 is a partial schematic view, from inside the vessel, showing a shifted outlet gate for work under reduced pressure, and the vacuum connections provided nearby.

FIG. 7 shows one embodiment of an outlet gate according to the invention, presenting a tunnel with its opening shifted toward the inside of the vessel. The tunnel is part of a corner-shaped removable piece possessing, on one side, a wing 28, roughly parallel to supporting unit 7 and resting on it by its two edges 29. The lower face of the wing 28 presents a recess whose profile is adapted to accommodate band 5 and strip 6. On the other side is a wing 30*a*, arranged in the same way as gate 27*b* of FIG. 10, whose face is turned toward the inside of the corner and trued in order to be applied tightly, under the effect of the vacuum prevailing in the vessel, against the outside wall 22 of the vessel. The outside wall 22 is in turn trued on its surface in contact with wing 30*a*. Owing to its removable character, this outlet gate has the advantage of being easily adapted to changes in working conditions, without requiring any other modification of the essential features of the device. It also prevents any blockage of the band caused by its free play, in case of malfunction.

Figure 8:
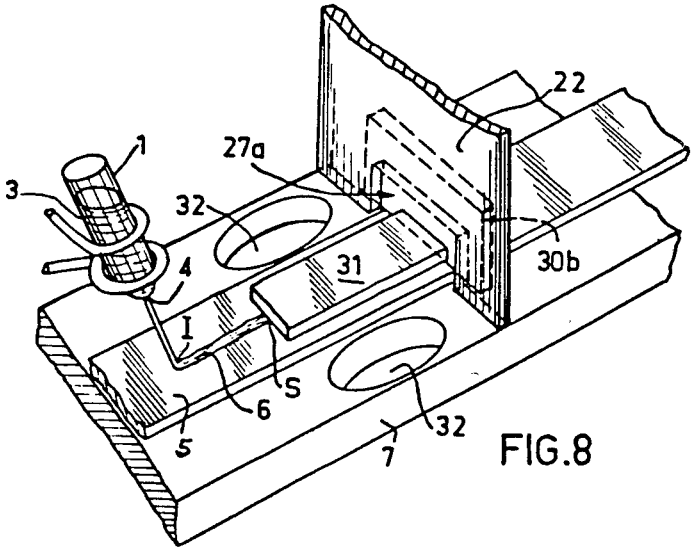
FIG. 8 is a similar view showing a hooded outlet structure.

In the variant containing a hood, represented by FIG. 8, the general shape of the removable piece resembles that of FIG. 7, with a wing 30*b* applied on wall 22. Its wing 31 does not, however, contain edges in contact with unit 7, but takes the form of a plate, the lower face of which is flat, roughly parallel to the band, and situated a short distance from same. The corner angle can advantageously be slightly less than 90 degrees, e.g., on the order of 85 to 88 degrees.

In FIGS. 7 and 8, the zones of impact of the molten alloy on band 5 have been marked by the letter I, and the points where strip 6 is engaged under wings 28 and 31 of the outlet gates, i.e., the inside thresholds of the gates, by the letter S. According to a feature of the invention, the distance IS must be less than a critical distance which depends on the working conditions.

Vessel 20 is equipped with vacuum connections 32, numbering two, placed beside band 5 as seen in FIGS. 7, 8 and 10. As indicated above, the openings 32 must be placed as close as possible to the gate of the vessel.

It has also been found that the best results are obtained when the jet of molten metal is inclined in relation to band 5, at an angle of 60 degrees, for example. Under these conditions, the metal strip is formed on band 5 with the smallest risk of drops of molten metal being splashed on the sides and toward the back.

Figure 9:
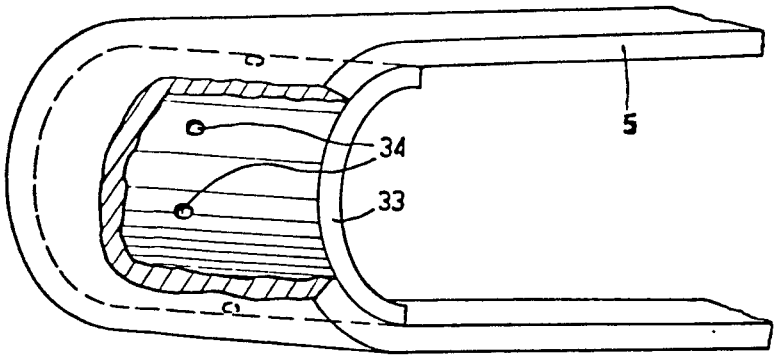
FIG. 9 is a broken-away schematic view showing a stationary curved return member for the moving band, which employs the Coanda effect.

As already indicated, one can advantageously substitute, for return pulleys 18 and 19, fixed curved return members 33, either convex (FIG. 9) or concave. Each such member 33 is bored with openings 34 for ejection of a gas under pressure, preferably at low temperature, whereby band 5 is applied by the Coanda effect against member 33. Friction of the band on the return members is thus avoided, which contributes to cooling band 5 and to limiting the band's vibrations.

EXAMPLE

One working example will now be described in detail. The apparatus includes an endless steel band, approximately 4 meters long and 16 mm by 1 mm in section, capable of being driven at a speed ranging between 0 and 3,000 m/minute. The band slides on a flat supporting unit 10 cm wide and 50 cm long, which includes openings for ejection of gas under pressure, 1.5 mm in diameter and 2 cm apart. The openings are arranged along the axis of the band, over the whole length of the unit, except opposite the vessel and inlet and outlet pieces, i.e., over approximately 15 cm. Crucibles 1 are used, drilled with an opening varying between 0.3 and 0.8 mm in diameter, approximately 5 mm away from the band and arranged so that the jet of molten metal forms an angle of 60 degrees with the latter. A 1.5-KW vacuum pump easily makes it possible to obtain an absolute pressure in the vessel of 0.05 bar. The excess pressure of ejection of molten metal through the opening makes it possible to regulate the flow, and was chosen for these tests to be on the order of 0.5 to 1 bar.

These embodiments of the invention make it possible to obtain metal glasses, particularly alloys of type $A_xB_{1-x}$, where A consists of one or more transition metals (Fe, Cr, Ni, Mn, Co, etc.), B consists of one or more metalloids (P, C, Si, B, etc.), and x, which is the atomic fraction of A, is of the order on 0.8. Those alloys are known to yield, by sudden solidification, products in the vitreous state.

The best results were obtained under reduced pressure, e.g., on the order of 0.05 bar, by means of the devices illustrated in FIG. 7 and 8.

For band speeds of 1,000 to 3,000 m/minute, and with a distance IS less than a critical value ranging between 10 and 20 mm and a tunnel or hood length on the order of 5 cm, it was possible to obtain with those alloys strips 1 to 7 mm wide and 30 to 100 microns thick; these strips presented regular edges and flat faces, qualities that can be attributed to work under vacuum. Furthermore, the products obtained exhibited a ductility greater than that of similar strips which are manufactured under vacuum in totally closed vessels. That advantage seems attributable to the very rapid outlet of the strip from the vessel under reduced pressure, which makes possible a more effective solidification, close to that obtained by solidification in a nonrarefied atmosphere, due to an increase in the rate of cooling of the metal alloy during the time the alloy is in the temperature zone above the so-called vitrification temperature.

This invention thus also concerns a process of manufacture of thin metal strips by projection of a jet of molten metal or alloy on a cold substrate moving at great speed, in which the impact of the jet and forming of the strip, in contact with the subtrate, takes place in an atmosphere under reduced pressure, and in which, before its temperature reaches the temperature of vitrification of said metal or alloy, the strip is brought into an atmosphere of higher pressure.

We claim:

1. A process of manufacturing a thin metal strip which comprises projecting a jet of molten metal or alloy on a cold substrate moving at great speed in an atmosphere under reduced pressure, and thereby forming the strip in contact with the substrate in said atmosphere under reduced pressure, and bringing the strip into an atmosphere of higher pressure before its temperature reaches the temperature of vitrification of said metal or alloy.

2. A process as in claim 1, in which the substrate is an endless metal band.

3. A process as in claim 1, including cooling the metal or alloy rapidly from above the liquidus temperature to below the temperature of vitrification by contact with the substrate.

4. A process as in claim 3, including cooling the metal or alloy at about $10^6$ degrees C. per second by contact with the substrate.

5. A method of rapidly solidifying a thin metallic strip comprising:

projecting a jet of molten metallic material onto a moving substrate in a controlled atmosphere;

cooling the metallic material by contact with the substrate; and rapidly bringing the strip into an atmosphere having higher pressure than said controlled atmosphere before the strip has cooled to the temperature of the substrate.

6. A method as in claim 5, including bringing the strip into the atmosphere of higher pressure before the strip has cooled to the vitrification temperature of the metallic material.

7. A method as in claim 5, including cooling the strip from above the liquidus temperature to below the vitrification temperature at about $10^6$ degrees C. per second.

8. A method as in claim 5, in which the substrate is a rapidly moving endless metal band and the strip is brought into the higher pressure atmosphere by being adhered to said metal band.

9. A method as in claim 5, further comprising selecting the metallic material from the group consisting of alloys of the type $A_xB_{1-x}$, where A consists of at least one transition metal, B consists of at least one metalloid, and x is about 0.7 to 0.9.

10. A method as in claim 9, wherein x is about 0.8.

11. A method as in claim 9, wherein A is at least one transition metal selected from the group consisting of Fe, Cr, Ni, Mn, and Co.

12. A method as in claim 9, wherein B is at least one metalloid selected from the group consisting of P, C, Si, and B.

13. A method of rapidly solidifying a thin metallic strip, comprising projecting a jet of molten metallic material onto a moving endless metal band;

cooling the metallic material by contact with the band; and cooling and stabilizing the band by locating at least one fluid source adjacent to the band to form a fluid cushion between the fluid source and the band near the point of impact of the metal jet on the band.

14. A method as in claim 13, further comprising further cooling and stabilizing the band by locating at least one additional fluid source adjacent to the band to form a fluid cushion between said additional fluid source and the band.

15. A method as in claim 13, including projecting the jet of molten material onto the band at an angle of about 60 degrees.

16. A method as in claim 13, further comprising reducing the atmospheric pressure in which the molten metallic material is projected by providing a vacuum vessel around the area where the metallic material is ejected and contacts the band.

17. A method as in claim 16, further comprising rapidly bringing the strip into an atmosphere of higher pressure after it contacts the band by providing an aperture in the vacuum vessel near the point of impact of the material on the band through which the moving band passes and carries the metallic material out of the vacuum vessel.

18. A method as in claim 17, including bringing the strip into the atmosphere of higher pressure before the strip has cooled to the vitrification temperature of the metallic material.

19. A method as in claim 17, including locating the aperture and the point of impact about 10 to 20 mm apart and moving the band at about 1000 to 3000 m/minute.

20. A method as in claim 17, including cooling the strip from above the liquidus temperature to below the vitrification temperature at about $10^6$ degrees C. per second.

21. A method as in claim 13, further comprising selecting the metallic material from the group consisting of alloys of the type $A_xB_{1-x}$, where A consists of at least one transition metal, B consists of at least one metalloid, and x is about 0.7 to 0.9.

22. A method as in claim 21, wherein x is about 0.8.

23. A method as in claim 21, wherein A is at least one transition metal selected from the group consisting of Fe, Cr, Ni, Mn, and Co.

24. A method as in claim 21, wherein B is at least one metalloid selected from the group consisting of P, C, Si, and B.

25. A method as in claim 13, further comprising locating a container for the molten metallic material above the metal band, providing an opening about 0.3 to 0.8 mm in diameter in the container, and subjecting the molten material to an excess pressure of about 0.5 to 1.0 bar to project the material from the container onto the metal band.

26. A method as in claim 25, including projecting the jet of molten material onto the band at an angle of about 60 degrees.

* * * * *